United States Patent [19]

Morris et al.

[11] 4,126,486

[45] Nov. 21, 1978

[54] PRODUCING IMPROVED METAL ALLOY PRODUCTS

[75] Inventors: Larry R. Morris, Yarker; John D. Thomson, Regina, both of Canada

[73] Assignee: Alcan Research and Development Limited, Montreal, Canada

[21] Appl. No.: 632,005

[22] Filed: Nov. 14, 1975

[30] Foreign Application Priority Data

Nov. 15, 1974 [GB] United Kingdom ..... 49639/74

[51] Int. Cl.[2] ..... C22F 1/04

[52] U.S. Cl. ..... 148/2; 29/527.7; 75/148; 148/11.5 A; 148/32

[58] Field of Search ..... 75/138, 148; 164/82, 164/89, 277, 282 M; 148/2, 3, 11.5 A, 12.7 A, 32; 29/527.7

[56] References Cited

U.S. PATENT DOCUMENTS

| | | | |
|---|---|---|---|
| 3,884,290 | 5/1975 | McCubbin | 164/82 |
| 3,930,895 | 1/1976 | Moser | 148/2 |
| 3,938,991 | 2/1976 | Sperry | 148/2 |
| 3,989,548 | 11/1976 | Morris | 148/11.5 A |

FOREIGN PATENT DOCUMENTS

| | | | |
|---|---|---|---|
| 2,418,389 | 10/1974 | Fed. Rep. of Germany | 75/148 |
| 1,378,743 | 12/1974 | United Kingdom | 75/148 |

OTHER PUBLICATIONS

Progress in Materials Science, vol. 12, Pergamon Press, N. Y., 1963, pp. 158–169.

*Primary Examiner*—R. Dean

*Attorney, Agent, or Firm*—Cooper, Dunham, Clark, Griffin & Moran

[57] ABSTRACT

A dispersion strengthened aluminum alloy is produced by continuously casting an aluminum alloy containing 4 - 15% Si and other optional constituents in the form of a slab at a growth rate in excess of 25 cm/min. to solidify silicon in the form of elongated rods in a size range of 0.05 - 0.5 microns diameter. The cast slab is then subjected to at least 60% reduction to fragment the elongated silicon rods into finely divided particles, at least the final part of the reduction being effected by cold rolling, the cold-rolled sheet being subjected to a final annealing treatment at a temperature in the range of 250° - 400° C.

7 Claims, 1 Drawing Figure

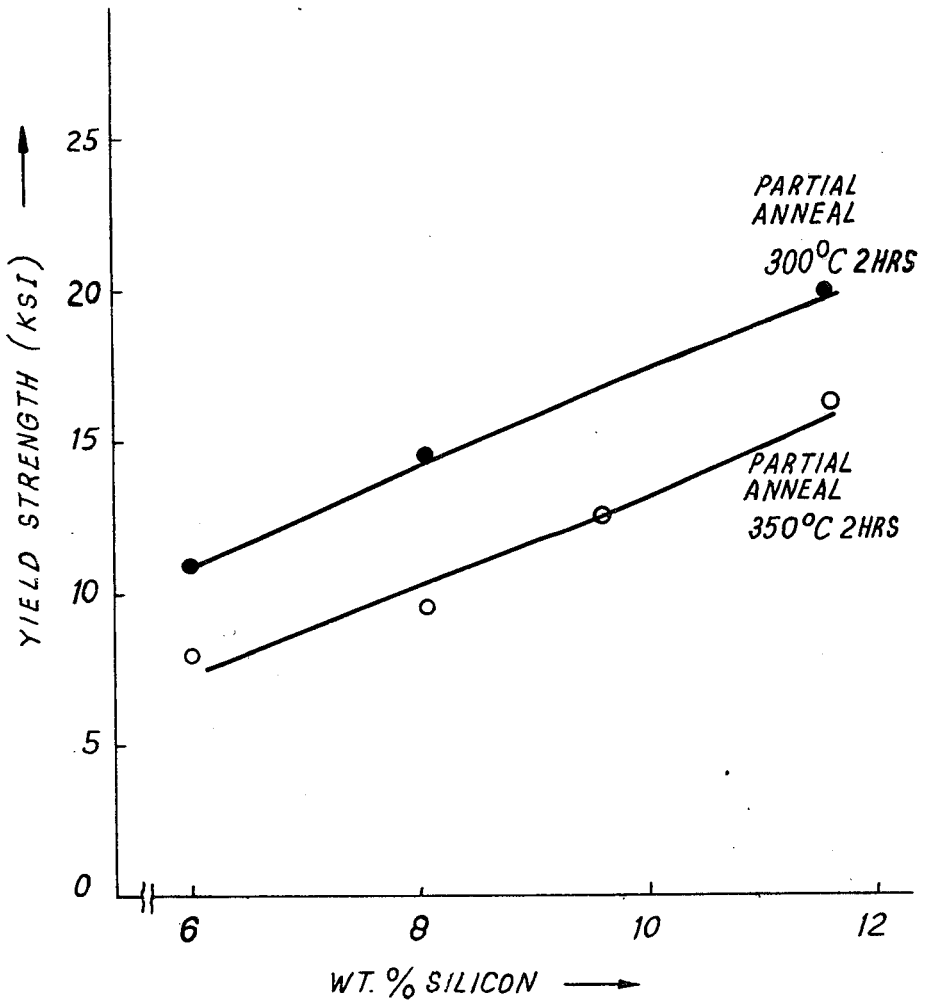
YIELD STRENGTH (KSI)
25
20
15
10
5
0
PARTIAL ANNEAL 300°C 2HRS
PARTIAL ANNEAL 350°C 2HRS
6
8
10
12
WT. % SILICON

PRODUCING IMPROVED METAL ALLOY PRODUCTS

The present invention relates to dispersion-strengthened aluminum alloys. The mechanical properties of a dispersion-strengthened alloy product are governed by a fine dispersion of microscopic insoluble particles and/or by the dislocation structure or grain structure resulting from the presence of these particles.

In co-pending patent application Ser. No. 471,133 now U.S. Pat. No. 3,989,548 issued Nov. 2, 1976 there is described the production of dispersion-strengthened aluminum alloys by working a cast mass of aluminum, in which brittle rod-like intermetallic phases, usually ternary intermetallic phases, are present, so as to segment the rod-like phases to form separate particles which are dispersed through the mass. It was found that when intermetallic particles of a size within the range of about 0.1–2 microns diameter form about 5.0–20 volume percent of an aluminum alloy, the worked alloy possesses very interesting mechanical properties. The mechanical properties of the alloy decline when the volume fraction of the intermetallic phase falls below 5.0%, while the ductility and toughness decline when the volume fraction exceeds 20%. The mechanical properties of the product are also adversely affected by the presence of coarse intermetallic particles of a size in excess of 3 microns diameter. The more uniform the dispersion of the intermetallic particles the better are the mechanical properties of the final product and for that reason the cast mass of aluminum was most preferably produced under such conditions that the areas free of rod-like phases are small.

The most convenient method for producing rod-like intermetallic phases in an aluminum mass is to cast a ternary eutectic alloy, incorporating alloying elements which form intermetallic phases with aluminum on solidification, under selected casting conditions to produce so-called "coupled growth". That phenomenon is well-known and is explained in an article by J. D. Livingston in "Material Science Engineering", Vol. 7 (1971), pages 61–70.

It was found possible to obtain the desired structure of closely spaced rods of the intermetallic phase by producing ingots by conventional direct chill continuous casting in the alloys considered in co-pending patent application Ser. No. 471,133, Pat. No. 3,989,548.

It was found that with the ternary eutectic alloy systems, to which that procedure is primarily applicable, the desired structure of intermetallic phases in the form of closely spaced rods of appropriate size could be achieved if the growth rate (rate of deposition of solid metal in a direction perpendicular to the solidification front) exceeded 1 cm/minute. It was also necessary to ensure that there was a suitable temperature gradient in the liquid metal to avoid the formation, as far as possible, of coarse primary intermetallic particles at localities in advance of the solidification front.

The method of co-pending patent application Ser. No. 471,133, U.S. Pat. No. 3,989,548 has been found very satisfactory for the production of aluminum alloy sheet having a good combination of yield strength and formability characteristics.

Aluminum-silicon alloys having 5–12% Si content have been known for many years. In such alloys the silicon content does not form an intermetallic phase and, when cast by the direct chill continuous casting process under the conditions employed for the production of ingots of substantial thickness (for example 10–30 cm), it is found that the silicon phase solidifies in the form of relatively coarse blade-like ribbons having a thickness in the range of 2–5 microns and a substantially greater width.

Al-Si alloy sheet has been rolled from such ingot material.

The alloy sheet in the as-rolled condition has satisfactory strength, but is too brittle to permit it to be formed. If the cold-rolled sheet is annealed at temperatures above 250° C. its ductility and formability are greatly improved but its yield strength has then fallen to about the level of annealed commercial purity aluminum sheet.

Although the product has found use in special applications, this has restricted to applications where low mechanical strength is acceptable.

As compared with many other aluminum alloys, Al-Si 5–12% alloys have several advantages. Silicon is a low cost alloying element. The alloys are inexpensive to process and have good corrosion resistance, so that their relatively low mechanical strength is unfortunate.

It is an object of the present invention to provide an improved method of processing these alloys to take advantage of these advantageous properties and in particular it is an object of the invention to provide a method of processing the alloys to provide alloy sheet which has acceptacle formability coupled with better tensile properties than are found in the alloys when subjected to rolling and annealing as described above.

We have now found that it is possible to obtain Al-Si 5–12% alloy products of improved mechanical properties by casting the alloy, utilizing special casting procedures which are effective to solidify the silicon content in the form of fine branched rods, i.e. rods in the range of about 0.05–0.5 microns in diameter and then subjecting the cast alloy to working so as to fracture the silicon rods and form a dispersion of fine silicon particles in a corresponding size range. The working should result in a reduction of at least 60% and may be hot or cold working. In most instances the reduction of the slab thickness will be effected solely by cold-rolling, but where the slab is reduced by hot-rolling, at least a further 10% reduction by cold-rolling is applied.

Fine silicon particle size produces some improvement in yield strength in the cold-rolled sheet in the as-rolled state, but that improvement is of little practical importance. There is however a very marked improvement in the yield strength of the sheet after partial annealing at a temperature in the range of 250°–400° C. while the formability of the sheet has improved to a level such that the sheet may be used for deep drawing or severe stretch-forming operations. Its suitability for this purpose is indicated by tensile elongation greater than 15%, preferably about 20%.

It is believed that the principal beneficial effect of the fine silicon particles in imparting this combination of adequate formability and improved yield strength in the partially annealed condition is that they retain a fine uniform grain or sub-grain size during the final annealing treatment. In order to achieve optimum results therefore the particle size is of importance and the dispersion of the particles through the alloy should be as uniform as possible. If the particles are coarse or unevenly dispersed the grains will be too large. On the other hand if the particles are too small (less than 0.05 microns) they will not have the effect of locking the grains. The grain boundaries will by-pass the particles and the material will have good formability, but low yield strength.

The presence of primary particles in the alloy in addition to the fine particles can be tolerated up to about 2% by volume, but these large particles lead to decreased formability and their formation should be avoided as far as possible. The process of the present invention is preferably applied only to Al-Si alloys containing 5–12% Si, but much of the benefits of the invention are obtained with hypereutectic alloys containing up to 15% Si. Below 5% Si the volume fraction of dispersed particles is too small to develop the desired tensile properties, accompanied by good formability.

The development of the desired structure in the cast material can only be achieved by continuous casting the alloy under conditions which lead to a growth rate of at least 25 cm/min. and more preferably at least 40 cm/min. and conveniently 50–85 cm/min. The diameter of the silicon rods decreases with increase in growth rate and as already noted the size of the silicon particles should not be less than about 0.05 microns. It is accordingly estimated that the growth rate during casting should not exceed about 250 cm/min. It is in any event extremely difficult to achieve so high a growth rate in any commercially practicable continuous casting operation. The cast material is normally cast as a continuous slab having a thickness of about 6 mm. The maximum slab thickness consistent with a growth rate of 25 cm/min. is about 25 mm.

It is however possible to reduce the Si content down to about 4% by weight. In such event it is preferred to incorporate additional alloying constituents which have the effect of raising the volume fraction of secondary phases above 5%. In particular the invention contemplates the addition of up to 2% Fe by weight and up to 2% Mn (total Fe & Mn 3% maximum). Up to 2% each Cu, Mg & Zn are also permissible, but preferably the total of Cu, Mg, Zn & Fe and Mn is held below 3% by weight. Other elements may be present in a total amount of 1% max. (0.5% each max.) It is however preferred that the total of other elements should be held below 0.15%. Where Fe is present in only the amounts conventional as impurity in commercial-purity aluminum, the total of impurities, including Fe, is preferably held below 0.5%, all alloying elements other than Cu, Mg and Mn being considered as impurities.

A non-continuous method of casting, such as casting into a permanent mould, does not achieve the desired structure, nor can it be achieved by procedures which require conversion of the liquid metal into discrete droplets, such as so-called splat casting.

In order to achieve optimum properties the casting procedure employed should result in the specified high growth rate substantially throughout the thickness of the cast material.

In procedures for casting thin aluminum slab using direct water cooling or chilled metal cooling systems, the rate of advance of the solid-liquid interface (growth rate) is close to the casting rate. With a thick ingot or a mould with low heat transfer rate, such as a belt caster, the growth rate will be much less than the casting rate. The growth rate is the important parameter since as the growth rate increases the number of Si rods increases (with correspondingly reduced diameter).

In practical high-volume casting equipment this requirement of high growth rate is most easily achieved by the use of twin-roll type casters, such as the continuous strip casters, manufactured by Hunter Engineering Company of Riverside, California, Unites States of America, in which the molten metal is solidified in the nip of a pair of heavily chilled rolls, which draw the molten metal upwardly out of an insulated injector nozzle in close proximity to the rolls. Typically in casting equipment of that type the cast material is in the form of a slab in a thickness range of 5–8 mm and is cast at a speed of 60–100 cm/min. (with a corresponding growth rate in the range of 50–85 cm/min.). The metal is essentially fully solidified when it passes the centre line of the caster rolls and it is subjected to heavy compression as it passes through the gap between the rolls with the consequence that its surfaces are in excellent heat exchange contact with the caster rolls.

It is found that by the use of this equipment Al-Si alloys, having a silicon content in the range of 5–12% can be cast in the form of a thin slab having substantially all the silicon in the form of fine rods. With a Si content in the range of 12–15% there may also be a content of primary silicon particles. This thin cast slab is then subjected to cold-rolling to effect at least 60% reduction and preferably even greater reductions are employed. This leads to the fragmentation of the silicon rods to form fine silicon particles which are very evenly dispersed throughout the material.

As compared with Al-Si alloy sheet of the same composition, but produced by hot-rolling ingots of conventional size, for example having a thickness of 10 cm produced by conventional direct chill continuous casting at a casting speed of 10 cm/min. (and corresponding growth rate of the order of 6–8 cm/min.) Al-Si alloy sheet produced by the procedure of the present invention exhibits a considerable increase in mechanical properties. A desirable combination of yield strength and formability is obtained when the cold worked sheet has been subjected to a partial annealing treatment, such as holding at 300° C. for 2 hours. It is believed that the principal beneficial effect of the silicon particles, in the size range obtained by fragmentation of the silicon rods, is that they retain or stabilize a fine uniform grain or sub-grain size.

In carrying out the procedure of the invention it is preferred that the silicon content of the alloy should be somewhat below the eutectic composition, in order to extend the freezing range. For example a Si content of 7–10% is preferred for the present purpose. The mechanical properties of the product may be improved by the addition of a small proportion, for example up to 2%, of Cu and/or Mg (not more than 3% in total). It is usually preferred for such addition (if made) to be 0.2–1% of Cu or Mg. In addition to improving the mechanical properties of the alloy sheet, it also reduces the anisotropy between the transverse and longitudinal properties. It in no way detracts from the advantages of the present procedure to incorporate small amounts of Fe and/or Mn, as already stated. These will solidify as a ternary intermetallic phase with Al and Si. However, the amount of such additional alloying elements should not be raised to such a level that the volume fraction of the precipitated Si and ternary intermetallic phases exceeds about 20%, since this leads to a decline in the toughness and ductility.

Thus, an illustrative alloy composition for the method and product of the present invention may consist essentially of Si, 7–10%; Cu, up to 1.0%; Mg, up to 1.0%; Mn, up to 1.0%; others, up to 0.3% each (total 1.0%); Al, remainder.

The following Example compares the structure of Al-9.5% Si in the as-cast condition when cast as a conventional Direct Chill ingot on the one hand and as thin slab as high growth rates in excess of 40 cm/min. on the other hand.

EXAMPLE I

EXAMPLE I

COMPARISON OF AS-CAST Al-9.5% Si STRUCTURES

| Casting | Conventional Direct Chill (D.C.) | Thin Direct Chill Slab | Twin Roll Caster Slab |
|---|---|---|---|
| Cross-Section | 10 × 23 cm | 0.6 × 30 cm | 0.7 × 83 cm |
| Casting Rate | 7.5–10 cm/min. | 75–120 cm/min | 60–80 cm/min. |
| Growth (Solidification) Rate | 6–8 cm/min. | 40–60 cm/min. | 50–75 cm/min. |
| Microstructure | Blade-like Si Ribbons | Fine branched Si rods | Fine branched Si rods |
| Silicon phase cross-section | 2–5 microns | less than ½ micron | less than ½ micron |

The following Example compares the strength and elongation properties of cold- rolled sheet produced from twin roll caster slab and thin D.C. slab cast at the high growth rates of Example 1 as compared with cold rolled sheet produced from a D.C. ingot, cast at conventional growth rates of the order of 6–8 cm/min.

The thin Direct Chill slab was cast by a procedure similar to standard Direct Chill casting, except that a very thin ingot is cast. The mould was a water-cooled copper mould, 19 mm in length, and applied a high velocity (150 cm/sec.) water film to the emerging ingot. The ingot casting rate was in the range 75–120 cm/min. The high casting rate in conjunction with the high rate of heat extraction from the thin slab gave very high growth rates in the central portion of the ingot.

Note:

(1) Ultimate Tensile Strength (UTS) and Yield Strength (YS) are averages from longitudinal and transverse standard sheet tensile specimens; elongations measured over 5 cm gauge length.

(2) As-cast 6 mm thick slab annealed 1 hour at indicated temperatures before cold rolling to 1 mm sheet.

(3) Standard D.C. Ingot, 10 cm thick, preheated to 350° C. hot rolled to 6 mm, then cold rolled to 1 mm.

EXAMPLE 2

Al-Si Alloys
Tensile Properties[1] of 1 mm. Thick Sheet

| Material | As-Rolled | | | Partial Anneal 300° C (2 hrs) | | | Partial Anneal 350° C (2 hrs) | | | Partial Anneal 400° C (2 hrs) | | |
|---|---|---|---|---|---|---|---|---|---|---|---|---|
| | UTS (ksi) | YS (ksi) | Elong. (%) | UTS (ksi) | YS (ksi) | Elong. (%) | UTS (ksi) | YS (ksi) | Elong. (%) | UTS (ksi) | YS (ksi) | Elong. (%) |
| A. Twin Roll Slab | | | | | | | | | | | | |
| 9.4% Si (Slab Annealed at 275° C)[2] | 41 | 31 | 7 | 29 | 21 | 16 | 27 | 18 | 20 | 25 | 15 | 20 |
| 9.4% Si (Slab Annealed at 350° C) | 39 | 28 | 6 | 27 | 18 | 21 | 25 | 16 | 21 | 23 | 12 | 24 |
| B. Thin D.C. Slab | | | | | | | | | | | | |
| 9.5% Si-0.06% Cu (Slab Annealed at 325° C) | 54 | 47 | 2 | 32 | 23 | 17 | 30 | 17 | 19 | 28 | 14 | 20 |
| 11.6% Si (Slab Annealed at 350° C) | 38 | 29 | 5 | 28 | 20 | 15 | 27 | 17 | 18 | | | |
| C. Standard D.C. Ingot | | | | | | | | | | | | |
| 9.5% Si (Ingot Annealed at 350° C)[3] | 34 | 25 | 7 | 20 | 8 | 33 | 21 | 7 | 28 | 20 | 7 | 30 |
| 12.0% Si (Ingot Annealed at 350° C) | 33 | 27 | 7 | 20 | 9 | 25 | 20 | 9 | 24 | 21 | 9 | 23 |

EXAMPLE 3

Thin D.C. slab was produced from Al-Si alloys of different Si content in a thickness of 6 mm at a growth rate of 40–60 cm/min. This was then cold-rolled to 1 mm sheet. The sheet was then partially annealed at 300° C. or 350° C. for 2 hours. The yield strength was then plotted against the % Si as shown in the accompanying FIG. 1, from which it will be seen that there was a progressive increase in yield strength as the Si content was increased through the range 6% Si to 11.5% Si.

The cast slab, having the rod-like silicon phase, may be coiled and dispatched for rolling and subsequent annealing at another location. It thus forms a valuable article of commerce in itself.

EXAMPLE 4

An aluminum silicon alloy having the composition Si 9.4%, Fe 0.17%, Ti 0.03%, Al Balance (impurities below 0.01% each) was cast in a Hunter Engineering Twin Roll Caster at a speed of 70 cm/min., thickness of 7.4 mm and width 84 cm. The molten alloy was supplied to the headbox of the machine at a temperature of about 610° C.

The cast slab was subjected to a slab-annealing or homogenizing treatment at a temperature in the range of 250°–400° C. before cold-rolling for at least ½ hour, to precipitate silicon from solid solution.

This slab-annealing treatment reduces the tendency to cracking, which may otherwise occur during the cold-rolling operation. Indeed it is very difficult to cold-roll the slab successfully unless it has first been subjected to such slab-annealing treatment.

We claim:

1. An aluminum alloy product formed from an alloy consisting essentially of the following composition:

Si 7–10%
Cu Up to 1.0%
Mg Up to 1.0%
Mn Up to 1.0%
Others Up to 0.3% each (up to 1.0% total)
Al Remainder the Si and intermetallic phases being essentially in the form of elongated rods in a size range of 0.05–0.5 microns and the product being essentially free from coarse primary particles, said aluminum alloy product being in the form of a continuously cast slab having a thickness of not more than 25 mm and suitable for subsequent rolling to sheet, and said rods being essentially uniformly dispersed throughout the entire thickness of said slab.

2. An aluminum alloy product according to claim 1 having a composition of

Si 7–10%
Cu 0.2–1.0%
Others Up to 0.5% total

3. A method of producing an aluminum-silicon alloy sheet product which comprises continuously casting an aluminum-silicon alloy in the form of a thin slab at a growth rate in excess of 25 cm/min. for solidifying silicon in the form of elongated rods in a size range of 0.05–0.5 microns essentially uniformly dispersed throughout the entire thickness of said slab, subjecting the cast slab to at least 60% reduction to fragment said silicon rods into finely divided separate particles, said slab being subjected to at least a final 10% reduction by cold-rolling, to convert it into final sheet form, said cold-rolled sheet being subjected to annealing at a temperature in the range of 250°–400° C., said alloy consisting essentially of the following composition Si 7–10%
Cu Up to 1.0%
Mg Up to 1.0%
Mn Up to 1.0%
Others Up to 0.3% each (up to 1.0% total)
Al Remainder.

4. A method according to claim 3 in which said alloy has the following composition Si 7–10%
Cu 0.2–1.0%
Others Up to 0.5% total 5. A method according to claim 3 in which the alloy is cast as a growth rate in the range of 40–85 cm/min.

6. A method according to claim 3 in which the cold rolled sheet is annealed at a temperature in the range 300°–350° C.

7. A method according to claim 3 in which the as-cast slab is annealed at a temperature of 250°–400° C. before cold-rolling.

* * * * *